United States Patent [19]

Kimmel

[11] Patent Number: 4,533,973

[45] Date of Patent: Aug. 6, 1985

[54] ELECTRICAL CIRCUIT FOR A COOKING APPARATUS AND METHOD OF MAKING THE SAME

[75] Inventor: Steven A. Kimmel, Greensburg, Pa.

[73] Assignee: Robertshaw Controls Company, Richmond, Va.

[21] Appl. No.: 583,334

[22] Filed: Feb. 24, 1984

[51] Int. Cl.[3] ..... F23Q 3/00

[52] U.S. Cl. ..... 361/253; 431/264

[58] Field of Search ..... 361/253; 431/264

[56] References Cited

U.S. PATENT DOCUMENTS

| | | | |
|---|---|---|---|
| 3,490,435 | 1/1970 | Rice | 431/264 X |
| 4,015,928 | 4/1977 | Carlson | 431/264 X |
| 4,404,616 | 9/1983 | Miyanaka et al. | 361/253 |
| 4,413,303 | 11/1983 | Cheary et al. | 361/253 |

OTHER PUBLICATIONS

Prior known electrical circuit as illustrated in FIG. 1 of this patent application.

*Primary Examiner*—Donald A. Griffin

*Attorney, Agent, or Firm*—Candor, Candor & Tassone

[57] ABSTRACT

An electrical circuit for a cooking apparatus and a method of making the same are provided, the circuit being adapted to cause sparking at a first igniter for a top burner by causing current flow through the primary of a first transformer and to cause sparking at a second igniter for an oven burner by causing current flow through the primary of a second transformer. The circuit has a main circuit branch having opposed ends and being adapted to be interconnected to an electrical power source at the opposed ends thereof so as to charge a main capacitor that causes the current flow through the primaries when a gate of an SCR of the main branch is activated, the circuit having two activating circuit branches each being adapted to activate the gate. Each activating branch has a neon bulb and a capacitor which causes its respective neon bulb to fire and activate the gate when its respective capacitor is charged to a value that reaches the breakover voltage of its respective neon bulb, one of the activating branches causing spark quenching when a flame appears in an oven spark gap. A switching arrangement is disposed in the circuit by being interconnected to the main circuit branch intermediate the opposed ends thereof and is adapted to selectively interconnect each activating branch to the main branch and thereby activate the interconnected activating branch so as to cause sparking at the igniter.

10 Claims, 2 Drawing Figures

ELECTRICAL CIRCUIT FOR A COOKING APPARATUS AND METHOD OF MAKING THE SAME

BACKGROUND OF THE INVENTION

1. Field of the Invention

This invention relates to an improved electrical circuit means for a cooking apparatus and to a method of making the same.

2. Prior Art Statement

It is known to provide an electrical circuit means for a cooking apparatus wherein the circuit means is adapted to cause sparking at first igniter means for top burner means of the apparatus by causing current flow through the primary of a first transformer and to cause sparking at second igniter means for oven burner means of the apparatus by causing current flow through the primary of a second transformer. Such circuit means has a main circuit branch adapted to be interconnected to an electrical power source so as to charge a main capacitor that causes the current flow through the primaries when a gate of an SCR of the main branch is activated, the circuit means having two activating circuit branches each being adapted to activate the gate. Each activating branch has a neon bulb and a capacitor which causes its respective neon blub to fire and activate the gate when its respective capacitor is charged to a value that reaches the breakover voltage of its respective neon bulb, one of the activating branches causing spark quenching when a flame appears in an oven spark gap. For example, see FIG. 1 of this application.

SUMMARY OF THE INVENTION

It is one feature of this invention to provide an improved electrical circuit means for a cooking apparatus wherein such electrical circuit means is adapted to cause sparking at igniter means for burner means of the apparatus.

In particular, it was found according to the teaching of this invention that a prior known electrical circuit means could be improved by providing a unique switching means for the SCR gate activating branches thereof which permits a reduced number of circuit components and thus a lowering of the production costs thereof.

For example, one embodiment of this invention provides an electrical circuit means for a cooking apparatus, the circuit means being adapted to cause sparking at first igniter means for top burner means of the apparatus by causing current flow through the primary of a first transformer and to cause sparking at second igniter means for the oven burner means of the apparatus by causing current flow through the primary of a second transformer. The circuit means has a main circuit branch provided with opposed ends and being adapted to be interconnected to an electrical power source at the opposed ends thereof so as to charge a main capacitor that causes the current flow through the primaries when a gate of an SCR of the main branch is activated, the circuit means having two activating circuit branches each being adapted to activate the gate. Each activating branch has a neon bulb and a capacitor which causes its respective neon bulb to fire and activate the gate when its respective capacitor is charged to a value that reaches the breakover voltage of its respective neon bulb, one of the activating branches causing spark quenching when a flame appears in an oven spark gap. A switching means is provided in the circuit means by being interconnected to the main circuit branch intermediate the opposed ends thereof and is adapted to selectively electrically interconnect each activating branch to the main branch and thereby activate the interconnected activating branch so as to cause sparking at the igniter means.

Accordingly, it is an object of this invention to provide an improved circuit means having one or more of the novel features of this invention as set forth above or hereinafter shown or described.

Another object of this invention is to provide an improved method of making such an electrical circuit means, the method of this invention having one or more of the novel features of this invention as set forth above or hereinafter shown or described. DR Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
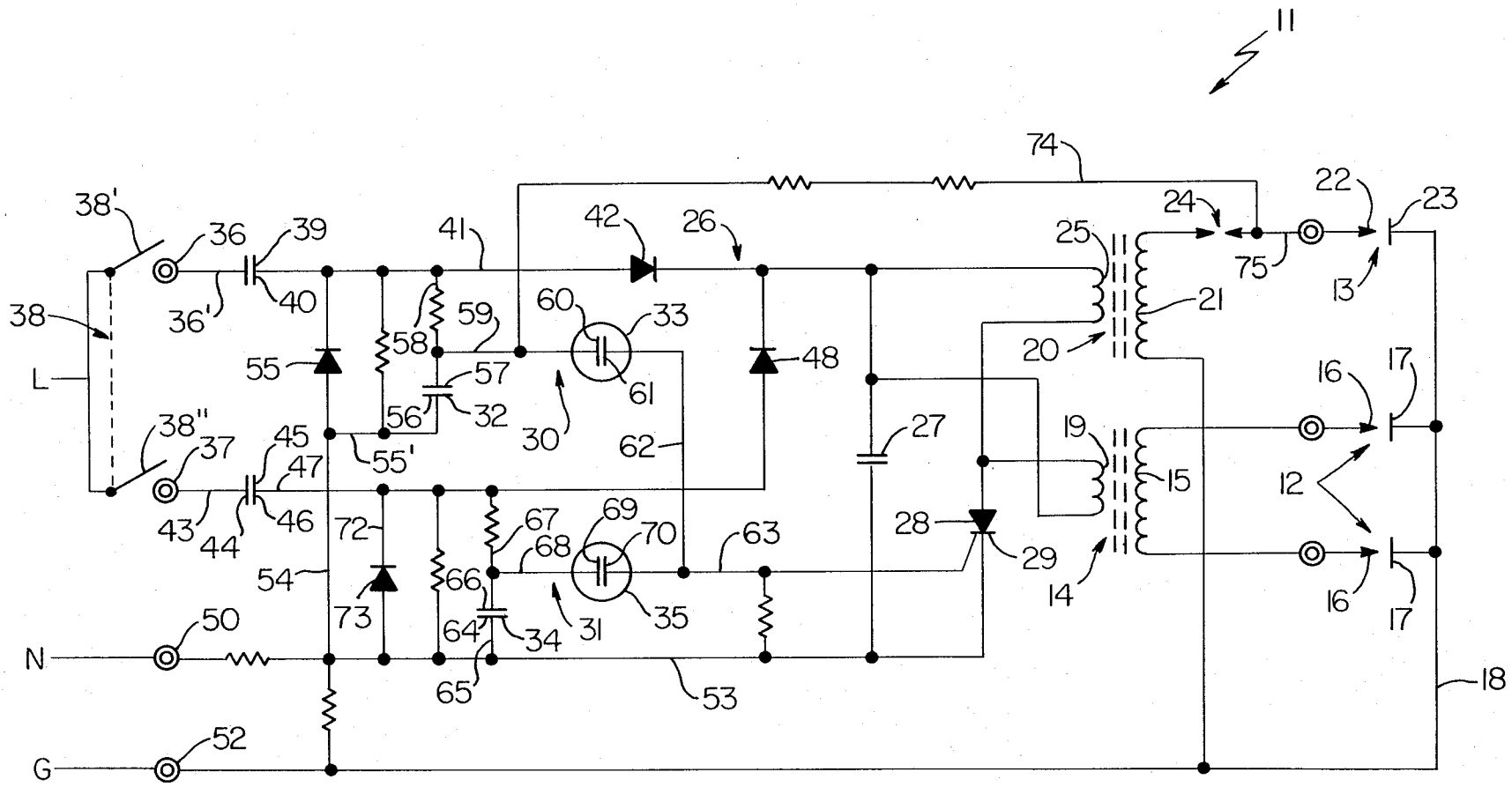
FIG. 1 PRIOR ART
FIG. 1 is an electrical diagram illustrating the prior known electrical circuit means being utilized to provide sparking for the burner means of a cooking apparatus.

While the various features of this invention are hereinafter illustrated and described as being particularly adapted to provide an electrical circuit means for a cooking apparatus, it is to be understood that the various features of this invention can be utilized singly or in various combinations thereof to provide an electrical circuit means for other apparatus as desired.

Therefore, this invention is not to be limited to only the embodiment illustrated in the drawings, because the drawings are merely utilized to illustrate one of the wide variety of uses of this invention.

Figure 2:
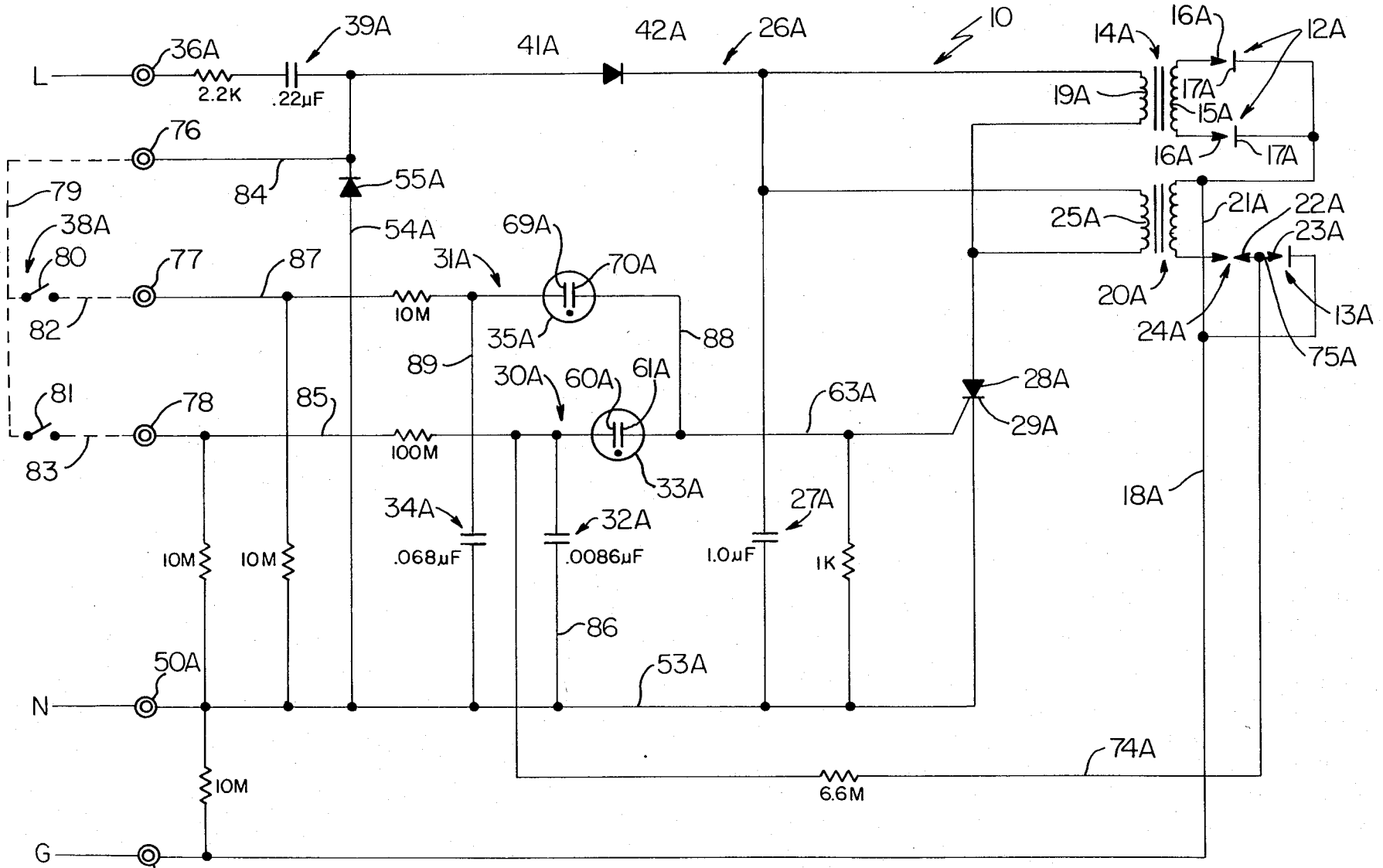
FIG. 2 is an electrical diagram illustrating the electrical circuit means of this invention being utilized to provide sparking for the burner means of a cooking apparatus.

The improved electrical circuit means of this invention is generally indicated by the reference numeral 10 in FIG. 2 and is believed to be an improvement over the electrical circuit means that is generally indicated by the reference numeral 11 in FIG. 1.

Accordingly, in order to fully understand the improvement in the electrical circuit means 10 of this invention, a description of the prior known electrical circuit means 11 of FIG. 1 will be first set forth.

The electrical circuit means 11 of FIG. 1 is to be utilized with a cooking apparatus (not shown) and has first igniter means that is generally indicated by the reference numeral 12 for causing sparking at top burner means (not shown) of the cooking apparatus and a second igniter means 13 for causing sparking for the oven burner means (not shown) of the cooking apparatus.

A first transformer means 14 is provided in the circuit means 11 and has its secondary coil 15 electrically interconnected to one side 16 of the igniter means 12 while the other side 17 of the igniter means 12 is interconnected by a lead means 18 to ground, it being understood that the ground for the igniter means 12 can be the frame of the cooking apparatus as is conventional in the art.

Thus, when an electrical current flows through the primary 19 of the first transformer means 14 in a manner hereinafter set forth, the secondary 15 will cause sparking at the igniter means 12 across the spark gaps between the sides 16 and 17 thereof in a manner well known in the art.

Similarly, a second transformer means 20 is provided in the circuit means 11 for the igniter means 13 and is adapted to have the secondary 21 thereof electrically interconnected to one side 22 of the igniter means 13 through an internal spark gap 24 while the other side 23 thereof is interconnected to the ground lead 18. When a flame is established at the oven igniter means 13 because the oven burner means has been successfully ignited by the sparking across the spark gap between the sides 22 and 23 of the oven igniter means 13, the circuit means 11 in a manner hereinafter set forth prevents further sparking at the igniter means 13 in a manner conventional in the art.

Thus, when current flows through the primary 25 of the transformer means 20 in a manner hereinafter set forth, the transformer 21 causes sparking at the igniter means 13 for the oven burner means of the cooking apparatus in a manner well known in the art.

The circuit means 11 includes a main circuit branch that is generally indicated by the reference numeral 26, the main circuit branch 26 including a main capacitor 27 and an SCR 28 that is adapted to have its gate 29 activated when either one of a pair of activating branches 30 and 31 of the circuit means 11 is activated. The activating branch 30 includes a capacitor 32 and a neon bulb 33 and the activating branch 31 also includes a capacitor 34 and a neon bulb 35.

The main branch 26 of the circuit means 11 includes a pair of terminals 36 and 37 which are adapted to be respectively and selectively interconnected to the "hot" line L of a conventional 120 volt alternating power source by a switch means 38 which has a pair of switch blades 38' and 38" for selectively either interconnecting the power source line L to the terminal 36 or to the terminal 37 or to both terminals 36 or 37 as will be apparent hereinafter.

The terminal 36 is interconnected by a lead 36' to one side of a capacitor 39 that has the other side 40 thereof interconnected to a lead 41 that includes the primary 25 of the transformer 20 therein and leads to the SCR 28, the lead 41 also having a diode 42 therein.

The terminal 37 is interconnected by a lead 43 to one side 44 of a capacitor 45 that has the other side 46 thereof interconnected by a lead 47 to the lead 41 at a point downstream from the diode 42, the lead 47 also having a diode therein.

A terminal 50 of the main branch 26 is interconnected to the neutral line N of the electrical power source while a terminal 52 of the main branch 26 is interconnected to a ground line G.

Thus, when the switch means 38 is operated to either place the switch blade 38' against the terminal 36 or the switch blade 38" against the terminal 37, the circuit means 11 can be properly energized whereby it can be seen that the leads L and N comprise the power source for the circuit means 11.

The terminal 50 of the circuit means 11 is interconnected by a lead 53 to the output side of the SCR 28. However, the lead 53 is not effectively electrically interconnected to the SCR until the gate 29 thereof is activated as is well known in the art.

The terminal 52 of the circuit means 11 is interconnected to the lead 18 previously described whereby the lead 18 provides a ground for the circuit means 11.

A lead 54 interconnects the lead 18 to the lead 41 as well as to the lead 53, the lead 54 having a diode 55 therein intermediate the leads 41 and 53.

The activating branch 30 has a lead 55' interconnected to the lead 54 and to the side 56 of the capacitor 32. The other side 57 of the capacitor 32 is interconnected by a lead 58 to the lead 41 as well as to a lead 59 that interconnects to one side 60 of the neon bulb 33. The other side 61 of the neon bulb 33 is interconnected by a lead 62 to a lead 63 that is interconnected to the gate 29 of the SCR 28 to cause the gate 29 to electrically interconnect the SCR 28 to the lead 53 when current flows to the gate 29 through the lead 63.

The activating branch 31 has one side 64 of the capacitor 34 interconnected to the lead 53 by a lead 65, the other side 66 of the capacitor 34 being interconnected to the lead 47 by a lead 67. The lead 67 is interconnected by a lead 68 to one side 69 of the neon bulb 35 which has its other side 70 interconnected to the lead 63.

The lead 53 is interconnected to the lead 47 by a lead 72 that has a diode 73 therein.

The lead 59 is interconnected by a feedback lead 74 to a lead 75 that is disposed intermediate the internal spark gap 24 and the oven spark gap 13 for a purpose hereinafter described.

The operation of the electrical circuit means 11 will now be described.

When the operator of the cooking apparatus desires to cause sparking at the oven burner means thereof in order to ignite the oven burner means, the operator operates the switch 38 to place the switch blade 38' against the terminal 36. The interconnection of the main circuit means 26 to the power source lead L causes the capacitor 27 to charge. However, the capacitor 27 cannot discharge so as to cause current flow through the primary 25 of the transformer 20 (as well as through the primary 19 of the transformer 14) until the gate 29 of the SCR 28 is activated by the activating circuit branch 30. The capacitor 32 is charged through lead 58, and when the charge on the capacitor 32 reaches the breakover voltage of the neon bulb 33, the neon bulb 33 fires and completes an electrical circuit to the gate 29 of the SCR. The activated SCR now discharges the large value capacitor 27 through the transformer primaries 25 and 19 so as to produce high voltage in the transformer secondaries 21 and 15 which causes sparking at the igniter spark means 13 and 12. Once the large capacitor 27 is discharged, the cycle begins over again and the capacitor 27 begins to charge as well as the small capacitor 32 to cause the neon bulb 33 to again fire and, thus, cause the gate 29 to open the SCR so that the capacitor 27 can be discharged through the primaries 25 and 19 to cause sparking at the spark igniter means 13 and 12.

Such sparking continues until a flame is established at the oven spark gap means 13. When such flame is established at the oven spark gap 13, lead 59 is connected to ground through the lead 74, lead 75, the flame itself at the spark gap 13 and lead 18 whereby the capacitor 32 cannot now charge to a level that is high enough to cause the neon bulb 60 to fire. Therefore, the gate 29 of the SCR 28 is no longer activated and the capacitor 27 can no longer be periodically discharged through the transformer primaries 25 and 19 whereby sparking no longer occurs at the spark means 13 and 12 so that sparking is successfully quenched by the activating circuit 30 when a flame appears at the igniter means or oven spark gap 13.

Should the operator desire to cause sparking at the igniter means 12 so as to ignite the top burners of the cooking apparatus either at the same time that the switch blade 38′ is against the terminal 36 or while the switch blade 38′ is in an open condition, the operator closes the switch blade 38″ against the terminal 37 which causes the changing of the main capacitor 27 by means of the lead 47, diode 48 and lead 41 in the manner previously described as well as causes the activating circuit branch 31 to activate by charging the capacitor 34 until the same reaches the breakover voltage which causes the neon bulb 35 to fire and thereby cause the gate 29 of the SCR 28 to turn on and discharge the capacitor 27 through the primaries 25 and 19 of the transformers 20 and 14 to cause sparking at the spark igniter means 13 and 12 in a repeating manner until the switch blade 38″ is moved back to an open condition which the operator will do when the operator sees that the top burners have been ignited.

The circuit means 10 of this invention that is illustrated in FIG. 2 basically operates in a manner similar to the circuit means 11 previously described except that the circuit means 10 of this invention does not have the diodes 48 and 73 and the capacitor 45 whereby it can be seen that the circuit means 11 of this invention permits a reduced number of circuit components and thus a lower product cost.

Since the majority of the circuit means 10 is substantially the same as the circuit means 11 previously described, parts of the circuit means 10 that are similar to parts of the circuit means 11 will be indicated by like reference numerals followed by the reference letter "A" whereby only the new portion of the circuit means 10 of this invention will now be specifically described.

In addition to the terminals 36A, 50A and 52A the circuit means 10 includes terminals 76, 77 and 78 with the terminal 76 being interconnected by a lead means 79 to switch blades 80 and 81 of the switch means 38A which are adapted to selectively interconnect the lead 79 to the terminals 77 and 78 through their respective leads 82 and 83 as illustrated, the lead L being directed interconnected to the terminal 36A.

The terminal 76 is in turn interconnected by a lead 84 to the lead 54A at a point intermediate the diode 55A and the diode 42A as well as at a point intermediate the diode 55A and the capacitor 39A.

The activating circuit branch 30A has a lead 85 interconnected to the terminal 78 as well as to the side 60A of the neon bulb 33A, the lead 85 being interconnected to the lead 53A by a lead 86 that has the capacitor 32A therein whereby the leads 85 and 86 of the circuit means 10 of this invention corresponds to the leads 58 and 55′ of the prior known circuit means 11.

The lead 85 is interconnected by the feedback lead 74A to the lead 75A that is disposed intermediate the internal spark gap 24A and the oven spark gap 13A for spark quenching purposes as previously described in connection with the feedback lead 74 of FIG. 1.

The side 61A of the neon bulb 33A of the activating branch 30A is interconnected to the lead 63A that controls the gate 29A of the SCR 28A.

The other activating branch 31A of the circuit means 10 comprises a lead 87 that is interconnected to the terminal 77 and to the side 69A of the neon bulb 35A which has its other side 70A interconnected to the lead 63A by a lead 88. The lead 87 is interconnected to the lead 53A by a lead 89 that has the capacitor 34A therein whereby the leads 87 and 89 correspond to the leads 67 and 65 of the circuit means 11 previously described.

The particular values of the various resistors and capacitors for the circuit means 10 for a particular application thereof are given in FIG. 2 and need not be further described as the function and operation thereof are known to persons skilled in the art.

Therefore, it can be seen that the circuit means 10 of this invention can be made in a relatively simple manner from the various parts illustrated in FIG. 2 by the method of this invention to operate in a manner now to be described.

When the operator desires to operate the circuit means 10 so as to provide sparking at the igniter means 13A for the oven burner means, the operator operates the switch 38A to cause the switch blade 81 to interconnect the common terminal 76 to the lead 83 whereby the large capacitor 27A is charged but cannot be discharged through the primaries 19A and 25A of the transformers 14A and 20A until the gate 29A of the SCR 28A is activated by the activating branch 30A by having the capacitor 32A charged through lead 85 until the same reaches the breakover voltage which causes the neon tube 33A to fire and thereby activate the gate 29A of the SCR 28A so that the capacitor 27A can be discharged through the SCR 28A and, thus, through the primaries 19A and 25A of the transformers 14A and 20A to cause sparking at both of the igniter means 12A and 13A. The activating circuit 30A continues to recycle in the manner previously described to cause cyclic sparking at the igniter means 12A and 13A until a flame exists in the oven spark gap 13A. When such flame is established at the oven spark gap 13A by having the sparking successfully igniting the oven burner means, lead 85 is connected to ground through the lead 74A, lead 75A, the flame itself now existing at the spark gap 13A and the ground lead 18A whereby the capacitor 32A cannot now charge to a level that is high enough to cause the neon bulb 60A to fire. Therefore, the gate 29A of the SCR 28A is no longer activated and the capacitor 27A can no longer be periodically discharged through the transformer primaries 25A and 19A whereby sparking no longer occurs at the spark means 13A and 12A so that sparking is successfully quenched by the activating circuit 30A when a flame appears at the igniter means or oven spark gap 13A.

When the operator desired to cause sparking at the igniter means 12A regardless of whether or not the switch blade 81 is in its closed position to cause sparking at the oven burner means, the operator closes the switch blade 80 which interconnects the common terminal 76 to the terminal 77 and, thus, causes the capacitor 34A to charge through lead 87 so that when the same reaches the breakover voltage of the neon bulb 35A, the neon bulb 35A fires and causes the gate 29A of the SCR 28A to be activated so that the SCR 28A will discharge the main capacitor 27A through the primaries 19A and 25A of the transformers 14A and 20A to cause sparking at the igniter means 12A and 13A in the manner previously described. The activating branch 31A will cycle the sparking operation each time the capacitor 34A reaches the breakover voltage in the manner previously described. Once the operator notices that the top burners have been ignited, the operator opens the blade 80.

Therefore, it can be seen that the circuit means 10 of this invention is adapted to cause sparking at the first igniter means 12A for the top burner means of a cooking apparatus by causing current flow through the primary 19A of a first transformer 14A and to cause sparking at second igniter means 13A for the oven burner means of the cooking apparatus by causing current flow through the primary 25A of a second transformer 20A. The circuit means 10 has a main circuit branch 26A adapted to be interconnected to an electrical power source L, N so as to charge a main capacitor 27A that causes the current flow through the primaries 19A and 25A when a gate 29A of an SCR 28A of the main branch 41A is activated. The circuit means 10 has two activating circuit branches 30A and 31A each being adapted to activate the gate 29A, each activating branch 30A or 31A having a neon bulb 33A or 35A and a capacitor 32A or 34A which causes its respective neon bulb 33A or 35A to fire and activate the gate 29A when its respective capacitor 32A or 34A reaches the breakover voltage of its respective neon bulb 33A or 35A. One 30A of the activating branches 30A and 31A causes spark quenching when a flame appears at the sound igniter means 13A. A switching means 38A is provided in the circuit means 10 that is adapted to selectively electrically interconnect each activating branch 30A or 31A to the main branch 30A or 31A so as to cause sparking at the igniter means 12A and 13A. The main circuit branch 26A has a pair of power source terminals 36A and 50A one 36A of which is to be interconnected to the "hot" line L of the power source and the other 50A of which is to be interconnected to a "neutral" line N of the power source, the main circuit branch 26A having a first lead means 41A interconnected to the one terminal 36A and having a first capacitor 39A therein. The switching means 38A is adapted to electrically interconnect the selected activating branch 30A or 31A to the first lead means 41A, the switching means 38A being adapted to electrically interconnect the selected activating branch 30A or 31A to the first lead means 41A at a point downstream from the first capacitor 39A. The first lead means 41A has a first diode 42A therein downstream from the first capacitor 39A and the switching means 38A is adapted to electrically interconnect the selected activating branch 30A or 31A to the first lead means 41A at a point intermediate the first capacitor 39A and the first diode 42A thereof. The main circuit branch 26A has a second lead means 54A interconnecting the other terminal 50A to the first lead means 41A at a point intermediate the first capacitor 39A and the first diode 42A thereof, the second lead means 54A having a second diode 55A. The switching means 38A is adapted to electrically interconnect the selected activating branch 30A or 31A to the first lead means 41A at a point intermediate the second diode 55A and the first diode 42A.

Accordingly, it can be seen that this invention provides an improved electrical circuit means for a cooking apparatus or the like and a method of making the same.

While the form and method of this invention now preferred have been illustrated and described as required by the Patent Statute, it is to be understood that other forms and method steps can be utilized and still fall within the scope of the appended claims.

What is claimed is:

1. In an electrical circuit means for a cooking apparatus, said circuit means being adapted to cause sparking at first igniter means for top burner means of said apparatus by causing current flow through the primary of a first transformer and to cause sparking at second igniter means for oven burner means to said apparatus by causing current flow through the primary of a second transformer, said circuit means having a main circuit branch having opposed ends and being adapted to be interconnected to an electrical power source at said opposed ends thereof so as to charge a main capacitor that causes said current flow through said primaries when a gate of an SCR of said main branch is activated, said circuit means having two activating circuit branches each being adapted to activate said gate, each activating branch having a neon bulb and a capacitor which causes its respective neon bulb to fire and activate said gate when its respective capacitor is charged to a value that reaches the breakover voltage of its respective neon bulb, one of said activating branches causing spark quenching when a flame appears at said second igniter means, the improvement comprising a switching means in said circuit means that is interconnected to said main circuit branch intermediate said opposed ends thereof and is adapted to selectively electrically interconnect each activating branch to said main branch and thereby activate the interconnected activating branch so as to cause sparking at said igniter means.

2. An electrical circuit means as set forth in claim 1 wherein said switching means is adapted to electrically interconnect both of said activating branches to said main branch at the same time.

3. In an electrical circuit means for a cooking apparatus, said circuit means being adapted to cause sparking at first igniter means for top burner means of said apparatus by causing current flow through the primary of a first transformer and to cause sparking at second igniter means for oven burner means of said apparatus by causing current flow through the primary of a second transformer, said circuit means having a main circuit branch having opposed ends and being adapted to be interconnected to an electrical power source at said opposed ends thereof so as to charge a main capacitor that causes said current flow through said primaries when a gate of an SCR of said main branch is activated, said circuit means having two activating circuit branches each being adapted to activate said gate, each activating branch having a neon bulb and a capacitor which causes its respective neon bulb to fire and activate said gate when its respective capacitor is charged to a value that reaches the breakover voltage of its respective neon bulb, one of said activating branches causing spark quenching when a flame appears at said second igniter means, the improvement comprising a switching means in said circuit means that is interconnected to said main circuit branch intermediate said opposed ends thereof and is adapted to selectively electrically interconnect each activating branch to said main branch and thereby activate the interconnected activating branch so as to cause sparking at said igniter means, said main circuit branch having a pair of power source terminals one of which is to be interconnected to a "hot" line of said power source and the other of which is to be interconnected to a "neutral" line of said power source whereby said terminals comprise said opposed ends of said main circuit branch, said main circuit branch having a first lead means interconnected to said one terminal and having a first capacitor therein, said switching means being adapted to electrically interconnect the selected activating branch to said first lead means at a point downstream from said first capacitor.

4. An electrical circuit means as set forth in claim 3 wherein said first lead means has a first diode therein downstream from said first capacitor, said switching means being adapted to electrically interconnect the selected activating branch to said first lead means at a point intermediate said first capacitor and said first diode thereof.

5. An electrical circuit means as set forth in claim 4 wherein said main circuit branch has a second lead means interconnecting said other terminal to said first lead means at a point intermediate said first capacitor and said first diode thereof, said second lead means having a second diode therein, said switching means being adapted to electrically interconnect the selected activating branch to said first lead means at a point intermediate said second diode and said first diode.

6. In a method of making an electrical circuit means for a cooking apparatus, said circuit means being adapted to cause sparking at first igniter means for top burner means of said apparatus by causing current flow through the primary of a first transformer and to cause sparking at second igniter means for oven burner means of said apparatus by causing current flow through the primary of a second transformer, said circuit means having a main circuit branch having opposed ends and being adapted to be interconnected to an electrical power source at said opposed ends thereof so as to charge a main capacitor that causes said current flow through said primaries when a gate of an SCR of said main branch is activated, said circuit means having two activating circuit branches each being adapted to activate said gate, each activating branch having a neon bulb and a capacitor which cause its respective neon bulb to fire and activate said gate when its respective capacitor is charged to a value that reaches the breakover voltage of its respective neon bulb, one of said activating branches causing spark quenching when a flame appears at said second igniter means, the improvement comprising the step of disposing a switching means in said current means by interconnecting said switching means to said main circuit branch intermediate said opposed ends thereof so that said switching means is adapted to selectively electrically interconnect each activating branch to said main branch and thereby activate the interconnected activating branch so as to cause sparking at said igniter means.

7. A method of making an electrical circuit means as set forth in claim 6 and including the step of forming said switching means to be adapted to electrically interconnect both of said activating branches to said main branch at the same time.

8. In a method of making an electrical circuit means for a cooking apparatus, said circuit means being adapted to cause sparking at first integer means for top burner means of said apparatus by causing current flow through the primary of a first transformer and to cause sparking at second igniter means for oven burner means of said apparatus by causing current flow through the primary of a second transformer, said circuit means having a main circuit branch having opposed ends and being adapted to be interconnected to an electrical power source at said opposed ends thereof so as to charge a main capacitor that causes said current flow through said primaries when a gate of an SCR of said main branch is activated, said circuit means having two activating circuit branches each being adapted to activate said gate, each activating branch having a neon bulb and a capacitor which causes its respective neon bulb to fire and activate said gate when it respective capacitor is charged to a value that reaches the breakover voltage of its respective neon bulb, one of said activating branches causing spark quenching when a flame appears at said second igniter means, the improvement comprising the steps of disposing a switching means in said current means by interconnecting said switching means to said main circuit branch intermediate said opposed ends thereof so that said switching means is adapted to selectively electrically interconnect each activating branch to said main branch and thereby activate the interconnected activating branch so as to cause sparking at said igniter means, forming said main circuit branch to have a pair of power source terminals one of which is to be interconnected to a "hot" line of said power source and the other of which is to be interconnected to a "neutral" line of said power source whereby said terminals comprise said opposed ends of said main circuit branch, forming said main circuit branch to have a first lead means interconnected to said one terminal and have a first capacitor therein, and forming said switching means to be adapted to electrically interconnect the selected activating branch to said first lead means at a point downstream from said first capacitor.

9. A method of making an electrical circuit means as set forth in claim 8 and including the steps of forming said first lead means to have a first diode therein downstream from said first capacitor, and forming said switching means to be adapted to electrically interconnect the selected activating branch to said first lead means at a point intermediate said first capacitor and said first diode thereof.

10. A method of making an electrical circuit means as set forth in claim 9 and including the steps of forming said main circuit branch to have a second lead means interconnecting said other terminal to said first lead means at a point intermediate said first capacitor and said first diode thereof, forming said second lead means to have a second diode therein, and forming said switching means to be adapted to electrically interconnect the selected activating branch to said first lead means at a point intermediate said second diode and said first diode.

* * * * *